United States Patent [19]

Pollak

[11] 4,060,205

[45] Nov. 29, 1977

[54] HYDRAULIC ACCUMULATOR FOR USE WITH GYRATORY CRUSHERS AND COMBINATION OF SUCH ACCUMULATOR WITH A GYRATORY CRUSHER

[75] Inventor: Robert J. Pollak, Appleton, Wis.

[73] Assignee: Allis-Chalmers Corporation, Milwaukee, Wis.

[21] Appl. No.: 740,114

[22] Filed: Nov. 8, 1976

[51] Int. Cl.[2] ..... B02C 2/06

[52] U.S. Cl. ..... 241/211; 138/26; 138/30; 138/44; 241/215; 241/290

[58] Field of Search ..... 241/207-216, 241/290; 220/85 B; 138/26, 30, 44

[56] References Cited

U.S. PATENT DOCUMENTS

| | | | |
|---|---|---|---|
| 2,579,516 | 12/1951 | Roubal | 241/215 |
| 2,667,309 | 1/1954 | Becker | 241/211 |
| 2,773,455 | 12/1956 | Mercier | 138/30 X |
| 3,801,026 | 4/1974 | Decker et al. | 241/215 |
| 3,830,259 | 8/1974 | Mercier | 138/30 |
| 3,873,037 | 5/1975 | Decker et al. | 241/213 X |

*Primary Examiner*—Roy Lake
*Assistant Examiner*—Howard N. Goldberg
*Attorney, Agent, or Firm*—Robert C. Sullivan

[57] ABSTRACT

A hydraulic accumulator particularly useful in connection with gyratory crushers of the type in which the crusher head and shaft are hydraulically supported so that when the crusher head encounters uncrushable material such as "tramp iron" the crusher head can move down to pass the tramp iron, causing at least some of the hydraulic fluid supporting the crusher shaft to be ejected to a hydraulic accumulator. A plurality of gyrations of the crusher may occur before the tramp iron passes. The accumulator chamber which receives the hydraulic fluid ejected from beneath the crusher shaft contains a gas precharged elastic bladder. Hydraulic fluid is admitted to the accumulator chamber through a poppet valve built into the accumulator structure, which valve is normally spring biased to a closed position against its valve seat. When the hydraulic pressure in the conduit connecting the hydraulic cylinder beneath the crusher shaft to the accumulator decreases to a predetermined value during a portion of each cycle of gyration of the crusher, the biasing spring closes the poppet valve and traps the hydraulic fluid in the accumulator chamber before any significant reverse hydraulic flow can occur, thereby preventing "water hammer" in the conduit connecting the hydraulic cylinder of the gyratory crusher to the accumulator. The poppet valve or the valve seat therefor are provided with a bleed passage or passages which permit a very restricted return hydraulic flow from the accumulator to the hydraulic cylinder of the gyratory crusher when the poppet valve is in closed position.

9 Claims, 4 Drawing Figures

HYDRAULIC ACCUMULATOR FOR USE WITH GYRATORY CRUSHERS AND COMBINATION OF SUCH ACCUMULATOR WITH A GYRATORY CRUSHER

BACKGROUND OF THE INVENTION

1. Field of the Invention

This invention relates to hydraulic accumulators adapted for use with gyratory crushers of the type in which hydraulic means is used to support the mainshaft on which the crushing head is mounted or otherwise supported, although the hydraulic accumulator of the invention is not necessarily restricted to such use; and the invention also relates to the combination of such hydraulic accumulator with a gyratory crusher.

2. Description of the Prior Art

It is well known in the prior art relating to gyratory crushers of the type using hydraulic means for supporting the mainshaft on which the crushing head is attached or otherwise supported to provide means for lowering the crushing head and the supporting shaft thereof when uncrushable material such as "tramp iron" enters the crushing chamber, whereby to permit the crusher to pass the tramp iron. "Tramp iron" is the term used in the art to designate an uncrushable object such as a metal dipper tooth or the like, for example, which is foreign to the mineral ore being processed by the crusher. The tramp iron relief is provided by conducting the hydraulic liquid beneath the piston which supports the crusher mainshaft to a hydraulic accumulator whereby the mainshaft and the crushing head supported thereby are lowered to permit passage of the tramp iron or the like through the crushing chamber. The hydraulic means for supporting the crusher shaft also permits lowering of the crusher shaft when other abnormal operating conditions are encountered, whereby to prevent breakage of the crusher parts. Examples of prior art patents showing the use of hydraulic accumulators for the purpose just mentioned in connection with gyratory crushers are U.S. Pat. No. 2,579,516 issued to Alexander J. Roubal on Dec. 25, 1951, and U.S. Pat. No. 2,667,309 issued to George D. Becker on Jan. 26, 1954.

Upon the presence of uncrushable material such as tramp iron in the crushing chamber of the gyratory chusher, during one gyration of the mainshaft to which the crushing head is attached or by which the crushing head is supported, 50 percent of the time the crushing head is closing on the tramp iron, forcing hydraulic fluid such as oil into the accumulator, and the other 50 percent of the time the crushing head is moving away from the tramp iron, and the accumulator is attempting to force the oil back to the cylinder in which the support piston which underlies the mainshaft is positioned.

Since the time period for one gyration of the mainshaft in a gyratory or cone crusher is a fraction of a second, the hydraulic oil must change directions rapidly. It is not possible for the oil to make a complete round trip from the cylinder for the support piston to the hydraulic accumulator and back to the cylinder in the very short time period of one gyration. Therefore, in the absence of a check valve in the hydraulic conduit connecting the crusher hydraulic cylinder to the accumulator, the oil going from the cylinder to the accumulator meets the oil going from the accumulator to the cylinder "head on." When this happens, "water hammer" occurs. The water hammer will build up in severity through each successive cycle of gyration until the connecting conduit from the cylinder to the accumulator breaks.

To prevent water hammer in a situation such as that just described, it has been the prior art practice to place a check valve in the hydraulic conduit connecting the accumulator to the cylinder for the support piston, this check valve being so constructed as to permit free flow of hydraulic oil from the crusher hydraulic cylinder to the accumulator but to provide a retarding action on the flow of the oil from the accumulator back to the cylinder. With each successive gyration, the crushing head hits the tramp iron and more oil is forced into the accumulator until the crushing chamber is opened far enough to pass the tramp iron. Upon clearance of the tramp iron through the crushing chamber, the oil is forced back to the cylinder for the support piston by the accumulator, setting the crushing head in its normal operating position. A check valve of the type just described connected in the hydraulic conduit from the accumulator to the cylinder for the support piston and permitting free flow of oil from the cylinder to the accumulator but retarding flow of oil from the accumulator back to the cylinder is diagrammatically shown as item 25 in the aforementioned U.S. Pat. No. 2,579,516 issued to Alexander J. Roubal. The use of a separate check valve such as the check valve 25 shown in the aforementioned U.S. Pat. No. 2,579,516, and the associated pipe fittings are relatively expensive.

STATEMENT OF THE INVENTION

Accordingly, it is an object of the present invention to provide a hydraulic accumulator particularly adapted for, although not necessarily restricted to, use with gyratory crushers of the type in which hyraulic means is used to support the mainshaft on which the crushing head is mounted or otherwise supported, the hydraulic accumulator being characterized by the fact that it incorporates within the accumulator structure a check valve means which retards the return hydraulic flow from the accumulator to the cylinder for the support piston associated with the mainshaft of the gyratory chamber, whereby to substantially eliminate "water hammer" in the hydraulic conduit connecting the crusher hydraulic cylinder to the accumulator.

It is a further object of the invention to provide a hydraulic accumulator for use with gyratory crushers of the type in which hydraulic means is used to support the mainshaft on which the crushing head is mounted or otherwise supported, and in which the accumulator incorporates a built-in check valve means which eliminates the necessity for a check valve in the conduit connecting the accumulator to the cylinder for the support piston associated with the mainshaft of the gyratory crusher for the purpose of restricting the return hydraulic flow from the accumulator to the cylinder as shown, for example, by the aforementioned U.S. Pat. No. 2,579,516 issued to Alexander J. Roubal; and in which the accumulator incorporating the built-in check valve in accordance with the present invention results in a substantial economic saving as compared to the prior art arrangement which required an accumulator and a check valve separate from each other.

It is a further object of the invention to provide in combination with a gyratory crusher of the type in which hydraulic means is used to support the mainshaft on which the crushing head is mounted or otherwise supported a hydraulic accumulator which is hydraulically connected to the cylinder for the support piston associated with the mainshaft of the crusher, and which hydraulic accumulator includes a built-in valve means for restricting return hydraulic flow from the accumulator to the cylinder, whereby to avoid "water hammer" when the crusher is in the process of clearing uncrushable material such as tramp iron through the crushing chamber of the crusher.

In achievement of these objectives, there is provided in accordance with an embodiment of the invention a hydraulic accumulator particularly useful in connection with, although not necessarily restricted to, gyratory crushers of the type in which the crusher head and shaft are hydraulically supported in such manner that when the crusher head encounters uncrushable material such as tramp iron or encounters some other abnormal condition requiring a downward movement of the crusher head and shaft, the crusher head can move down to pass the tramp iron or the like, causing at least some of the hydraulic fluid supporting the crusher shaft to be ejected to a hydraulic accumulator. The accumulator chamber which receives the hydraulic fluid ejected from beneath the crusher shaft contains an elastic bladder member of rubber or the like containing a precharge of gas. In an embodiment of the invention, the hydraulic fluid is admitted to the accumulator chamber through a poppet valve built into the accumulator structure, which valve is normally biased to closed position against its valve seat by a biasing spring, the poppet valve being opened against the pressure of the gas precharged bladder and against the biasing spring force to admit hydraulic fluid to the accumulator chamber when the crusher is working to eject tramp iron from the crushing chamber. When the hydraulic pressure in the hydraulic conduit connecting the hydraulic cylinder beneath the crusher shaft to the accumulator and pushing on the valve in one direction subsequently decreases to a value which is equal to or slightly greater than the hydraulic pressure in the accumulator chamber pushing on the valve in the opposite direction, the biasing spring closes the poppet valve and traps the hydraulic fluid in the accumulator chamber before any reverse hydraulic flow can pass through the open valve. The poppet valve or the valve seat therefor are provided with a bleed passage or passages which permit a very restricted return hydraulic flow from the accumulator to the hydraulic cylinder of the gyratory crusher when the poppet valve associated with the accumulator is in closed position. By thus restricting the reverse hydraulic flow from the accumulator to the hydraulic cylinder of the gyratory crusher, "water hammer" is prevented in the hydraulic conduit connecting the hydraulic cylinder of the gyratory crusher to the accumulator, particularly during the interval in which the gyratory crusher is attempting to pass the tramp iron. The invention is also directed to the combination with a gyratory crusher of the aforementioned hydraulic accumulator having the built-in hydraulic flow control valve.

BRIEF DESCRIPTION OF THE DRAWINGS

Further objects and advantages of the invention will become apparent from the following description taken in conjunction with the accompanying drawing in which.

DESCRIPTION OF THE PREFERRED EMBODIMENT

Figures 1, 2, 3, 4:
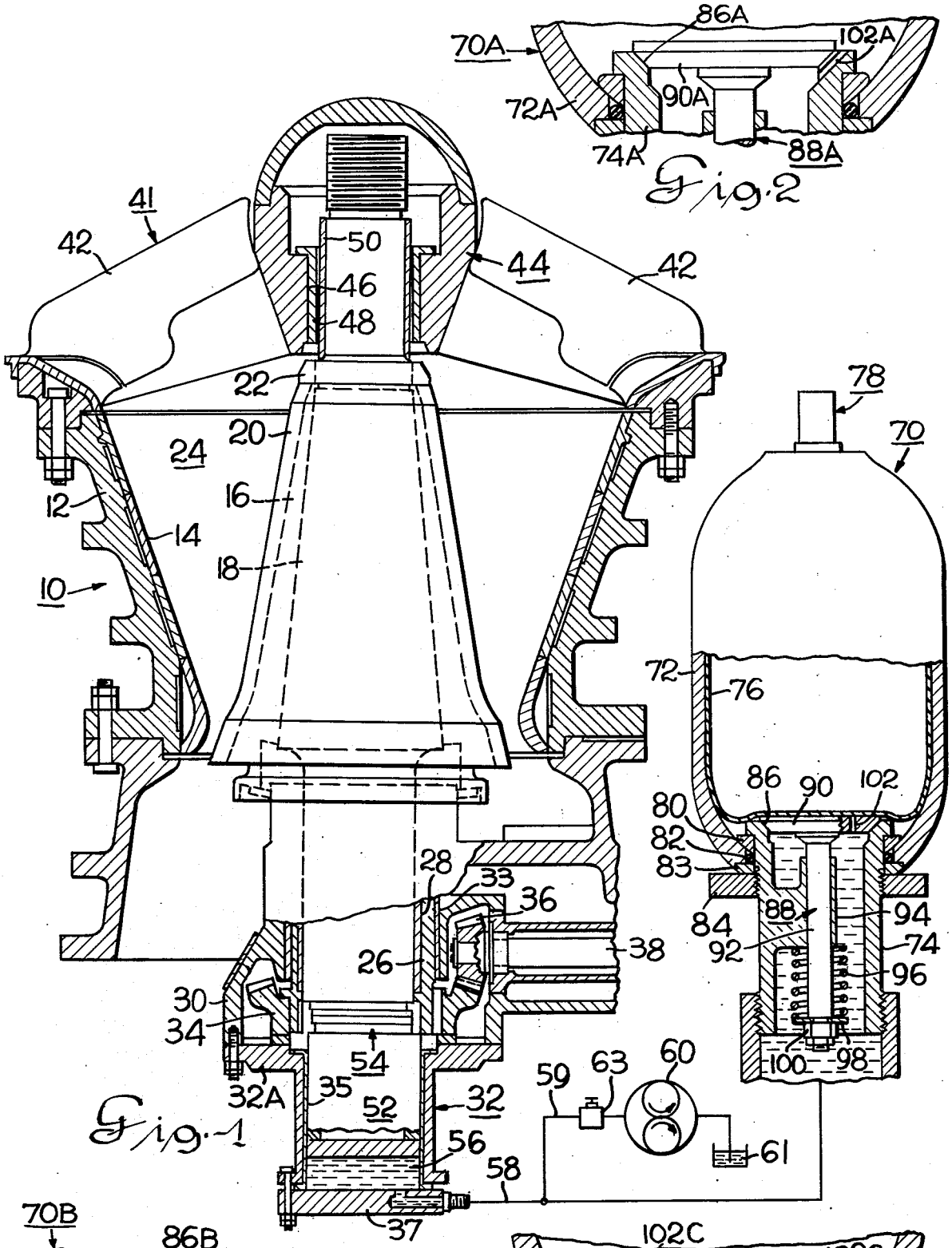
FIG. 1 is a view partially in vertical elevation and partially in vertical section of a gyratory crusher having the cylinder for the support piston for the gyratory crusher head and shaft hydraulically connected to a hydraulic accumulator in accordance with the invention, the accumulator in FIG. 1 being provided with a bleed hole or passage through the head of the poppet valve of the accumulator for the purpose of restricting or retarding return hydraulic flow from the accumulator to the cylinder for the support piston of the gyratory crusher.
FIG. 2 is a fragmentary view showing a modified accumulator construction in accordance with the invention in accordance with which the bleed hole or passage is located in the valve seat rather than in the valve head.
FIG. 3 is a fragmentary view of a still further modified hydraulic accumulator construction in accordance with the invention in which the head of the poppet valve is provided with a bleed groove or grooves in the tapered surface of the valve head which interfaces with the valve seat.
FIG. 4 is a still further modified embodiment of a hydraulic accumulator construction in accordance with the invention in which the tapered surface of the valve seat which interfaces with the head of the poppet valve when the poppet valve is in closed position is provided with a bleed groove or grooves for the return flow of hydraulic fluid from the accumulator to the cylinder for the support piston of the gyratory crusher.

Referring now to the drawing, there is shown a gyratory crusher generally indicated at 10 of the spider bearing type. Crusher 10 includes an upper frame section 12 within which is supported a bowl liner or concave 14. A crusher head 16 is mounted on shaft 18 and a crusher mantle 20 is secured on shaft 18 and on crusher head 16 by a head nut 22. A crushing chamber 24 is defined between bowl liner 14 and crusher mantle 20. The lower portion of shaft 18 is journalled within the eccentric vertical bore of an eccentric 26 by means of a bearing sleeve or liner 28 positioned within the eccentric bore.

Eccentric 26 is cylindrical and is supported for rotation by a pedestal-like inner frame portion 30 and by horizontal portion 32A of the base portion generally indicated at 32. A bearing sleeve or liner 33 is positioned between eccentric 26 and frame portion 30 to journal eccentric 26 for rotation. Eccentric 26 is rotated by the engagement of ring gear 34 on eccentric 26 with the mating pinion gear 36 mounted on drive shaft 38.

Rotation of eccentric 26 by means of gears 34, 36 imparts a gyratory movement to crusher head 16 and crusher shaft 18 about a fulcrum located on a vertical axis central of crushing chamber 24 and of spider hub 44, as is well known in the art, and as set forth, for example, in U.S. Pat. No. 3,813,047, issued to James D. Torrence et al on May 28, 1974.

The spider assembly generally indicated at 41 is suitably supported on the upper end of upper frame section 12, spider assembly 41 including a plurality of radially extending arms 42 which supports a centrally located spider hub, generally indicated at 44. Spider hub 44 is provided with an axial passage 46 therethrough. Axial passage 46 of spider hub 44 is lined with a flanged spider bushing 48. The upper end of crusher shaft 18 extends through and is journalled by bushing 48 of spider hub 44. The upper end of crusher shaft 18 is provided with a replaceable wear sleeve 50.

The lower end of shaft 18 is supported by a piston 52. A step bearing generally indicated at 54 is interposed beneath the lower end of shaft 18 and the upper surface of piston 52. The base portion 32 and the sleeve or liner 35 which lines the interior of base portion 32 cooperate with lower horizontal base portion 37 to define a cylinder or chamber 56 in which piston 52 is vertically movable. Hydraulic liquid such as oil is admitted to or ejected from cylinder 56, whereby to control the height of piston 52 in cylinder 56 and thus whereby to control the vertical height of crusher shaft 18 and of crusher head 16 mounted on crusher shaft 18.

Shaft 18 and crusher head 16 may be vertically adjusted by either the introduction of hydraulic fluid into cylinder 56 beneath the lower end of piston 52 for the purpose of elevating shaft 18 and crusher head 16; or conversely, by the withdrawal of hydraulic fluid from cylinder 56 beneath piston 52 for the purpose of lowering shaft 18 and crusher head 16. The interior of cylinder 56 beneath piston 52 is hydraulically connected by means of hydraulic conduits 58 and 59 in series with a shut-off valve 63 to a reversible pump 60, which is connected to a reservoir 61 for hydraulic fluid, such as oil. Crusher head 16 and shaft 18 are maintained at the desired vertical setting by introducing the appropriate volume of hydraulic fluid beneath piston 52 by means of pump 60, after which operation of pump 60 is discontinued and shut-off valve 63 is closed. Pump 60 may be operated in either direction to change the adjusted vertical setting of crusher head 16 and shaft 18. "Make-up" hydraulic liquid to replace losses of hydraulic liquid may also be introduced as required, in the same manner as just described.

The space beneath piston 52 in cylinder 56 is also connected by hydraulic conduit 58 to the hydraulic inlet plug 74 of a hydraulic accumulator generally indicated at 70.

Except for the modifications to be hereinafter described, hydraulic accumulator 70 may be a commercially available hydraulic accumulator of the type manufactured by Greer Olaer Products, a Division of Greer Hydraulics Inc., 5930 W. Jefferson Boulevard, Los Angeles 16, Cal.

The accumulator generally indicated at 70 includes an outer shell 72 defining a hollow chamber having positioned on the interior thereof a flexible or elastic bladder member 76 made of rubber or other suitable elastomeric material. The bladder 76 is in fluid communication at the upper end thereof relative to the view shown in FIG. 1 with the gas valve assembly generally indicated at 78 through which a suitable gas such as nitrogen, for example, may be introduced into the hollow interior of bladder 76 whereby to precharge the interior of bladder 76 to a predetermined desired gas pressure.

The inlet plug 74 of accumulator 70 extends through an opening in the lower end of outer shell 72 and is suitably secured in a fixed and leak-proof position relative to outer shell 72 by a retaining ring 80, an O-ring 82, a washer 83, and a lock nut 84. The upper end of inlet plug 74 is provided with a tapered inner periphery to define a valve seat 86 adapted to receive the valve head 90 of a poppet valve generally indicated at 88. The poppet valve 88 includes a valve stem 92 which is slidably received by the guide portion 94 of inlet plug 74. A helical spring 96 surrounds the lower end of valve stem 92. The upper end of spring 96 bears against the under surface of guide portion 94 of inlet plug 74, while the lower end of spring 96 bears against a spring seat defined by a washer 98 which bears against the upper surface of a nut member 100 which is threadedly engaged with the lower portion of valve stem 92.

Spring 96 normally maintains poppet valve 88 in the closed position shown in the view of FIG. 1 in which valve head 90 is seated on valve seat 86. Spring 96 is a "light" spring, that is, a spring having a low spring rate such as a spring rate in the range 5 to 10 pounds. The "spring rate" is the force required to compress the spring a distance of one inch.

An important feature of the construction is the provision of a bleed hole or passage 102 in head 90 of poppet valve 88 for the purpose of restricting return flow of hydraulic fluid from the interior of accumulator shell 72 to cylinder 56 associated with gyratory crusher 10 for the purpose of preventing "water hammer" as will be described in more detail hereinafter.

In the view shown in FIG. 1 of the drawing, crusher head 16 and shaft 18 of gyratory crusher 10 are shown in a raised position which is assumed to be the "set" position of the crusher for a particular crushing operation. In this position of crusher head 16 and crusher shaft 18, and assuming that no uncrushable material such as tramp iron has entered crushing chamber 24, and that no other abnormal operating condition exists which would tend to cause lowering of the crusher head and crusher shaft, bladder 76 of accumulator 70 will be expanded by the internal pressure of its precharge of nitrogen gas so as to occupy substantially the entire internal volume of shell 72 as seen in FIG. 1, and there will be no hydraulic oil present within accumulator shell 72.

The precharge pressure of the gas in the elastic bladder member 76 should be such that under normal operating conditions of the gyratory crusher and in the absence of any uncrushable material such as tramp iron in the crushing chamber, and in the absence of any abnormal operating condition which would tend to cause lowering of the crusher head and crusher shaft, the hydraulic pressure in conduit 58 connecting crusher cylinder 56 to hyraulic accumulator 70 and pushing upwardly on valve 88 will be no greater than the sum of the downwardly acting pressure of the gas precharged bladder 76 of accumulator 70 plus the downward biasing force of spring 96 which biases poppet valve 88 to closed position. Under "normal" crushing conditions bladder 76 will be expanded to fill substantially the entire internal volume of hollow accumulator tank or chamber 72, and there will be no hydraulic oil or hydraulic fluid in accumulator chamber 72.

There is shown in FIG. 2 a fragmentary view of a modified bleed passage arrangement for metering the return flow from the accumulator 70 to the hydraulic cylinder 56 associated with the gyratory crusher. Except for the modified bleed passage arrangement to be described, the structure shown in FIG. 2 is otherwise similar to the structure shown and described in connection with the embodiment of FIG. 1, and similar parts in FIG. 2 have the same reference numerals as FIG. 1 applied thereto, except that the subscript "A" forms part of the reference numerals in the embodiment of FIG. 2. Thus, in the modified embodiment of FIG. 2, one or more bleed passages 102A are located in valve seat 86A but in outwardly spaced relation to the tapered surface of valve seat 86A which interfaces with valve head 90A. In other words, bleed passage or passages 102A of the embodiment of FIG. 2 lie in the valve seat and communicate the hollow interior of plug member 74A and hence the connected hollow interior of conduit 58, with the hollow interior of accumulator chamber 72A even when valve member 88A is closed.

Referring now to FIG. 3, there is shown a still further modified arrangement of the bleed passage or passages which may be used instead of the arrangement of the bleed passage or passages shown in FIGS. 1 and 2. The structure shown in FIG. 3 is otherwise similar to the accumulator structures shown in FIGS. 1 and 2 and similar parts are similarly numbered, except that the reference numerals in the embodiment of FIG. 3 have the subscript "B" at the end of the respective reference numerals.

Referring to the modified embodiment of FIG. 3, it will be seen that bleed passages 102B are provided in valve head 90B at the surface of the valve head which interfaces with valve seat 86B. Bleed passages 102B fluidly communicate the hollow interior of accumulator tank 72B with the hollow interior of inlet plug 74B which, in turn, communicates with the hollow interior of hydraulic conduit 58, even when valve member 88B is seated on valve seat 86B.

Referring now to FIG. 4, there is shown a still further modified bleed passage or passages which retard the reverse hydraulic flow from the accumulator chamber back to the hydraulic cylinder associated with the gyratory crusher. Except for the difference in the location of the bleed passages to be hereinafter described, the structure shown in FIG. 4 is the same as that previously described in connection with FIGS. 1, 2 and 3, and similar reference numerals will be used as in the other figures except that in FIG. 4, the subscript "C" follows the various reference numerals. Thus, in the modified embodiment of FIG. 4, the tapered surface of valve seat 86C which interfaces with the tapered surface of valve head 90C of valve member 88C is provided with one or more grooves 102C whereby when valve head 90C is seated on the valve seat, as seen in FIG. 4, the hydraulic fluid in the accumulator chamber may bleed through groove or grooves 102C from the accumulator chamber into the hollow interior of valve plug 74C and thus into hydraulic conduit 58, when the hydraulic pressure in the interior of accumulator chamber 72C is greater than the hydraulic pressure in the hollow interior of valve plug 74C and in the connected hollow interior of conduit 58 which leads to hydraulic cylinder 56 associated with gyratory crusher 10.

Description of Operation

When gyratory crusher 10 is operating normally and has not encountered a piece of tramp metal or other uncrushable material and has not encountered any other abnormal operating condition which would tend to cause crusher head 16 and crusher shaft 18 to move in a downward direction relative to the view of FIG. 1, the hydraulic pressure in conduit 58 will be such that the elements of accumulator 70 will be in the position shown in FIG. 1 in which valve 88 is closed, and in which the precharge gas pressure within elastic bladder 76 will cause bladder 76 to expand to fill substantially the entire volume of the hollow interior of accumulator tank 72, as seen in the view of FIG. 1.

Assume now that a piece of tramp metal such as a metal dipper tooth, or other uncrushable material, is present in the crushing chamber 24. While the time required for the crusher to pass or clear this uncrushable material may vary widely, typically the time required for the crusher to clear or pass the uncrushable material, such as the tramp iron, may vary from, for example, 1 second to about ½ minute. Thus, if the eccentric 26 which causes the gyratory movement of the crusher head and shaft is rotating 360 revolutions per minute, which is a typical speed of rotation of the eccentric, the number of cycles of gyration required for the crusher to clear the uncrushable material may vary from, for example, 6 cycles of gyration to, for example, 180 cycles of gyration.

Consider what happens on the first cycle or gyration of the gyratory crusher: During one half of the first cycle of gyration, crushing head 16 is closing on the tramp metal, causing the hydraulic pressure in conduit 58 which connects the crusher to accumulator 70 to increase to a value which exceeds the sum of the downwardly acting pressure exerted by the gas precharged bladder 76 on valve 88 plus the downward biasing force of spring 96 which also biases poppet valve 88 toward closed position. When this condition occurs, poppet valve 88 rises off of and above valve seat 86 and admits some hydraulic fluid from hydraulic conduit 58 into the interior of accumulator chamber 72. This hyrdraulic fluid admitted into accumulator chamber 72 will cause some compression of bladder 76. Also, the increment of flow of hydraulic fluid out of crusher hydraulic cylinder 56 which occurs during the half cycle of gyration when the crusher head is closing on the tramp metal causes a corresponding lowering of the crusher shaft and crusher head.

On the next half cycle of the first cycle of gyration after encountering the tramp metal, crushing head 16 moves away from the tramp metal and consequently the hydraylic pressure in conduit 58 leading to accumulator 70 begins to decrease. When the decreasing pressure in hydraulic conduit 58 pushing upwardly on valve 88 drops to a pressure value at which it is just equal to or possibly even slightly higher than the hydraulic pressure in accumulator chamber 72, pushing downwardly on valve 88, spring 96 closes valve 88 into engagement with valve seat 86, corresponding to the position seen in FIG. 1 of the drawing, before there can be any reverse flow of hydraulic fluid through the open valve 88 from accumulator chamber 72 back into hydraulic conduit 58 leading to the crusher. It is true that after valve 88 is closed, as just described, there will be a small amount of hydraulic fluid passing through bleed passage or passages 102 (FIG. 1) from accumulator chamber 72 back into hydraulic conduit 58 on the aforementioned "next" half cycle of gyration just described when the hydraulic pressure in accumulator tank 72 becomes greater than the decreasing hydraulic pressure in conduit 58. However, the amount of hydraulic fluid which will pass through bleed passage 102 in the reverse direction toward hydraulic cylinder 56 of crusher 10 when valve 88 is closed on the aforementioned "next" half cycle of the first cycle of gyration after encountering the tramp metal, and when the crusher head is moving away from the tramp metal, as just described, is negligible, as compared to the amount of hydraulic fluid which entered accumulator chamber 72 on the preceding half cycle of the first cycle of gyration (when crusher head 16 was closing on the tramp metal), since the ratio of the size of the opening for passage of hydraulic fluid when poppet valve 88 is open, as compared to the size of the fluid passage through bleed passage 102 when valve 88 is closed is typically of the order of magnitude of 140:1.

Thus, one the first cycle of gyration of the crusher head and shaft after the tramp metal or other uncrushable material is first encountered, as well as on all of the subsequent cycles of gyration until the tramp metal is finally cleared and passes through the crusher, only a negligible flow of hydraulic fluid occurs in the reverse direction from accumulator chamber 72 back into hydraulic conduit 58, and thus, the problem of "water hammer" is eliminated since during the period when the tramp iron or other uncrushable material is being cleared, substantially all of the hydraulic flow is from the crusher hydraulic cylinder 56 through hydraulic conduit 58 to accumulator chamber 72, and there is only a negligible flow of hydraulic fluid in the reverse direction from accumulator chamber 72 back into hydraulic conduit 58.

The sequence of events which occurs on the two half cycles of the first cycle of gyration of head member 16 and shaft 18 of the gyratory crusher after first encountering the tramp iron or other uncrushable material, in which the crusher head first moves toward or closes on the uncrushable material to increase the hydraulic pressure in hydraulic conduit 58 and to cause hydraulic flow from crusher cylinder 56 through conduit 58 to accumulator chamber 72, with the crusher head then moving away from the uncrushable material to decrease the hydraulic pressure in hydraulic conduit 58, is substantially repeated on each subsequent gyration of the crusher head and shaft during the time interval in which the crusher is attempting to clear or pass the uncrushable material.

As more hydraulic fluid is admitted to the accumulator chamber 72 on subsequent cycles of gyration after the first cycle of gyration just described, the amount of hydraulic fluid in the accumulator chamber 72 continues to increase, increasing the pressure of the gas confined within elastic bladder 76, and causing bladder 76 to become reduced in volume and to raise up out of contact with valve head 90, away from the position shown in FIG. 1 of the drawing. As additional hydraulic fluid is admitted into accumulator chamber 72 with each successive gyration of the crusher head during the period while the crusher is attempting to clear the uncrushable material, the hydraulic pressure inside the accumulator will continue to increase, with the result that in order to open valve 88 to admit additional hydraulic fluid into accumulator chamber 72 on any successive cycle of gyration, the hydraulic pressure in conduit 58 required to open valve 88 becomes successively greater with each successive cycle of gyration.

As more and more hydraulic fluid is admitted from hydraulic cylinder 56 through hydraulic conduit 58 into accumulator chamber 72, piston 52 which supports crusher shaft 18 and crusher head 16 will continue to lower until finally the crusher shaft and crusher head have been sufficiently lowered to permit passage through crushing chamber 24 of the tramp iron or other uncrushable material.

When the tramp iron has finally passed out of crushing chamber 24, there is a sudden reduction in the hydraulic pressure in hydraulic conduit 58 and, at the moment when the level of the decreasing hydraulic pressure in conduit 58 acting upwardly on valve 88 reaches a value slightly greater than or equal to the pressure in accumulator chamber 72 acting downwardly on valve 88, biasing spring 96 causes valve 88 to close into engagement with valve seat 86 in the same manner as previously described. However, when valve 88 closes after the uncrushable material has finally been cleared through the crushing chamber, valve 88 then remains closed, and the higher pressure of the hydraulic fluid in accumulator chamber 72, as compared to the now reduced hydraulic pressure in hydraulic conduit 58, causes the compressed bladder 76 to expand and slowly eject the hydraulic fluid in accumulator chamber 72 through the bleed passage or passages 102 at a retarded rate of flow. This causes piston 52 beneath crusher head 18 to gradually move upwardly until crusher head 16 is again positioned at its "set point" corresponding to normal crusher operation. When this has occured, all of the hydraulic fluid in accumulator chamber 72 will have been ejected from chamber 72 and elastic bladder 76 will have expanded to substantially completely occupy the entire volume of accumulator chamber 72 as shown in FIG. 1 of the drawing, with the precharged bladder 76 bearing against the upper surface of valve head 90 in the same manner as shown in FIG. 1.

While the operation of accumulator 70 in conjunction with gyratory crusher 10 has been described in connection with the embodiment of FIG. 1, an accumulator structure, such as 70A, 70B, and 70C, incorporating the various modified arrangements of the bleeder passages, such as 102A, 102B and 102C, would operate in the same manner as described in connection with the embodiment of FIG. 1.

From the foregoing detailed description of the invention, it has been shown how the objects of the invention have been obtained in a preferred manner. However, modifications and equivalents of the disclosed concepts such as readily occur to those skilled in the art are intended to be included within the scope of this invention.

The embodiments of the invention in which an exclusive property or privilege is claimed are defined as follows:

1. In combination, a gyratory crusher, said crusher comprising a crusher head and a shaft-like member in supporting relation to said crusher head, means forming part of the crusher structure and defining a crusher hydraulic chamber for receiving a hydraulic fluid which is in supporting relation to said shaft-like member and to said crusher head, a hydraulic accumulator located in spaced relation to said crusher, a hydraulic conduit fluidly connecting said crusher hydraulic chamber and said hydraulic accumulator, said hydraulic accumulator comprising a hollow accumulator chamber for receiving hydraulic fluid from said crusher hydraulic chamber whereby to permit lowering of said shaft-like member and said crusher head when said crusher encounters uncrushable material, said crusher head during the period when it is attempting to pass uncrushable matter through the crusher moving toward the uncrushable material on one part of each gyratory cycle whereby to increase the hydraulic pressure in said hydraulic conduit and moving away from said uncrushable material on another part of each gyratory cycle whereby to reduce the hydraulic pressure in said hydraulic conduit, an elastic bladder member positioned in said accumulator chamber, said bladder member containing a precharge of a gas at a predetermined precharge pressure, valve means incorporated as part of the accumulator structure for controlling flow of hydraulic fluid between said hydraulic conduit and said accumulator chamber, spring means engaging said valve means and biasing said valve means toward a closed position, said valve means being openable to admit hydraulic fluid from said hydraulic conduit into the interior of said accumulator chamber during said one part of the gyratory cycle in which said crusher head is moving toward said uncrushable material, said spring means being adapted to close said valve means to prevent any significant reverse hydraulic flow from said accumulator chamber into said hydraulic conduit during said another part of the gyratory cycle when said crusher head is moving away from said uncrushable material, whereby to prevent "water hammer" in said hydraulic conduit, and bleed passage means fluidly communicating the interior of said accumulator chamber with said hydraulic conduit, said bleed passage means being effective to permit a restricted reverse flow of hydraulic fluid from said accumulator chamber into said hydraulic conduit and thus to said crusher hydraulic chamber with said valve means in closed position whereby to cause a gradual upward movement of said shaft-like member and said crusher head after the uncrushable material has passed through said crusher.

2. The combination defined in claim 1 in which said bleed passage means is provided in said valve means.

3. The combination defined in claim 1 in which said accumulator structure includes a valve seat means for said valve means, said valve means being engageable with said valve seat means when said valve means is in closed position, and said bleed passage means is provided in said valve seat means.

4. In a hydraulic accumulator for use in combination with a gyratory crusher and in which said crusher comprises a crusher head and a shaft-like member in supporting relation to said crusher head, and in which said crusher additionally comprises means forming part of the crusher structure and defining a crusher hydraulic chamber for receiving a hydraulic fluid which is in supporting relation to said shaft-like member and to said crusher head, said hydraulic accumulator being adapted to be located in spaced relation to said crusher and being adapted to be fluidly connected by a hydraulic conduit to said crusher hydraulic chamber, and in which said hydraulic accumulator comprises a hollow accumulator chamber for receiving hydraulic fluid from said crusher hydraulic chamber whereby to permit lowering of said shaft-like member and said crusher head when said crusher encounters uncrushable material, said crusher head during the period when it is attempting to pass uncrushable material through the crusher moving toward the uncrushable material on one part of each gyratory cycle whereby to increase the hydraulic pressure in said hydraulic conduit and moving away from said uncrushable material on another part of each gyratory cycle whereby to reduce the hydraulic pressure in said hydraulic conduit, and in which an elastic bladder member is positioned in said accumulator chamber, said bladder member containing a precharge of a gas at a predetermined precharge pressure, the improvement which comprises valve means incorporated as part of the accumulator structure for controlling flow of hydraulic fluid between said hydraulic conduit and said accumulator chamber, spring means engaging said valve means and biasing said valve means toward closed position, said valve means being openable to admit hydraulic fluid from said hydraulic conduit into the interior of said accumulator chamber during said one part of the gyratory cycle in which said crusher head is moving toward said uncrushable material, said spring means being adapted to close said valve means to prevent any significant reverse hydraulic flow from said accumulator chamber into said hydraulic conduit during said another part of the gyratory cycle when said crusher head is moving away from the uncrushable material, whereby to prevent "water hammer" in said hydraulic conduit, and bleed passage means fluidly communicating the interior of said accumulator chamber with said hydraulic conduit, said bleed passage means being effective to permit a restricted reverse flow of hydraulic fluid from said accumulator chamber into said hydraulic conduit and thus to said crusher hydraulic chamber with said valve means in closed position whereby to cause a gradual upward movement of said shaft-like member and said crusher head after the uncrushable material has passed through said crusher.

5. The hydraulic accumulator defined in claim 4 in which said bleed passage means is provided in said valve means.

6. The hydraulic accumulator defined in claim 4 in which said accumulator structure includes a valve seat means for said valve means, said valve means being engageable with said valve seat means when said valve means is in closed position, and said bleed passage means is provided in said valve seat means.

7. A hydraulic accumulator adapted to be connected to a hydraulic conduit, said hydraulic accumulator comprising a hollow accumulator chamber for receiving hydraulic fluid from said hydraulic conduit, an elastic bladder member positioned in said accumulator chamber, said bladder memeber containing a precharge of a gas at a predetermined precharge pressure, valve means incorporated as part of the accumulator structure for controlling flow of hydraulic fluid between said hydraulic conduit and said accumulator chamber, spring means engaging said valve means and biasing said valve means toward a closed position, said valve means being openable to admit hydraulic fluid from said hydraulic conduit into the interior of said accumulator chamber when the force exerted on said valve means in a valve opening direction by the hydraulic fluid in said conduit exceeds the sum of the forces exerted on said valve means in a valve closing direction from within said accumulator chamber and by said spring means, said spring means being adapted to close said valve means to prevent any significant reverse hydraulic flow from said accumulator chamber into said hydraulic conduit when the force acting on said valve means in a valve opening direction by the hydraulic fluid in said hydraulic conduit decreases to a predetermined relation to the force in said accumulator chamber acting in a valve closing direction on said valve means, and bleed passage means fluidly communicating the interior of said accumulator chamber with said hydraulic conduit, said bleed passage means being effective to permit a restricted reverse flow of hydraulic fluid from said accumulator chamber into said hydraulic conduit.

8. The hydraulic accumulator defined in claim 7 in which said bleed passage means is provided in said valve means.

9. The hydraulic accumulator defined in claim 7 in which said accumulator structure includes a valve seat means for said valve means, said valve means being engageable with said valve seat means when said valve means is in closed position, and said bleed passage means is provided in said valve seat means.

* * * * *